United States Patent [19]

Walker

[11] Patent Number: 4,523,855

[45] Date of Patent: Jun. 18, 1985

[54] SHAKER

[76] Inventor: Robert L. Walker, 20 White Oaks Cir., St. Charles, Ill. 60174

[21] Appl. No.: 606,263

[22] Filed: May 2, 1984

[51] Int. Cl.[3] ..... B01F 11/00

[52] U.S. Cl. ..... 366/211; 366/237

[58] Field of Search ..... 366/110, 209, 210, 211, 366/214, 216, 237, 111, 238, 605

[56] References Cited

U.S. PATENT DOCUMENTS

| | | | |
|---|---|---|---|
| 2,735,663 | 2/1956 | Holt | 366/211 |
| 3,331,588 | 7/1967 | Nasser | 366/211 |
| 3,437,317 | 4/1969 | Miein | 366/211 |
| 3,735,964 | 5/1973 | Lorenzen | 366/211 |

*Primary Examiner*—Robert W. Jenkins

*Attorney, Agent, or Firm*—John L. Schmitt

[57] ABSTRACT

A shaker particularly adapted for mixing the components of a liquid base material in a miniature size container includes a housing which carries a low voltage, high speed rotary output electric motor. The motor may be energized by batteries or by a domestic power source through an adaptor. An eccentrically offset bearing member attached to the motor rotates to reciprocate a connecting rod which in turn oscillates a cradle about its vertical axis. To mix the contents of the container, the container is set in the cradle in a horizontal orientation and held in such by a strap. This orientation not only promotes mixing by placing the contents in a gravitationally unstable position but subjects the contents to centrifugal and horizontal accelerating and deaccelerating forces during oscillation. Within a short time period the components are mixed to a homogeneous consistency.

6 Claims, 6 Drawing Figures

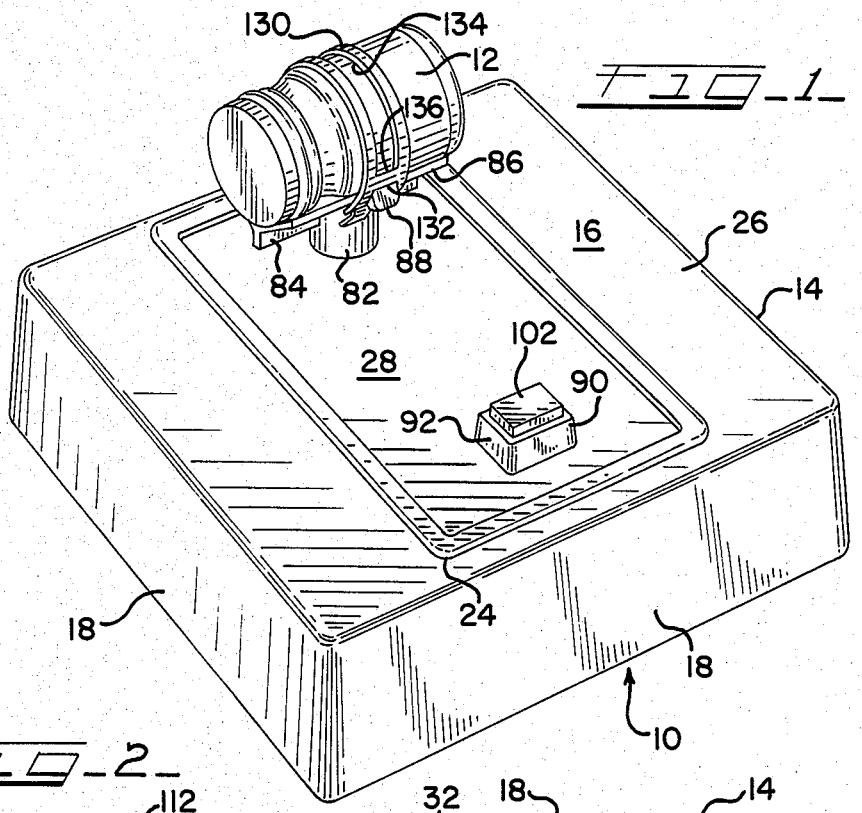
FIG. 1
FIG. 2
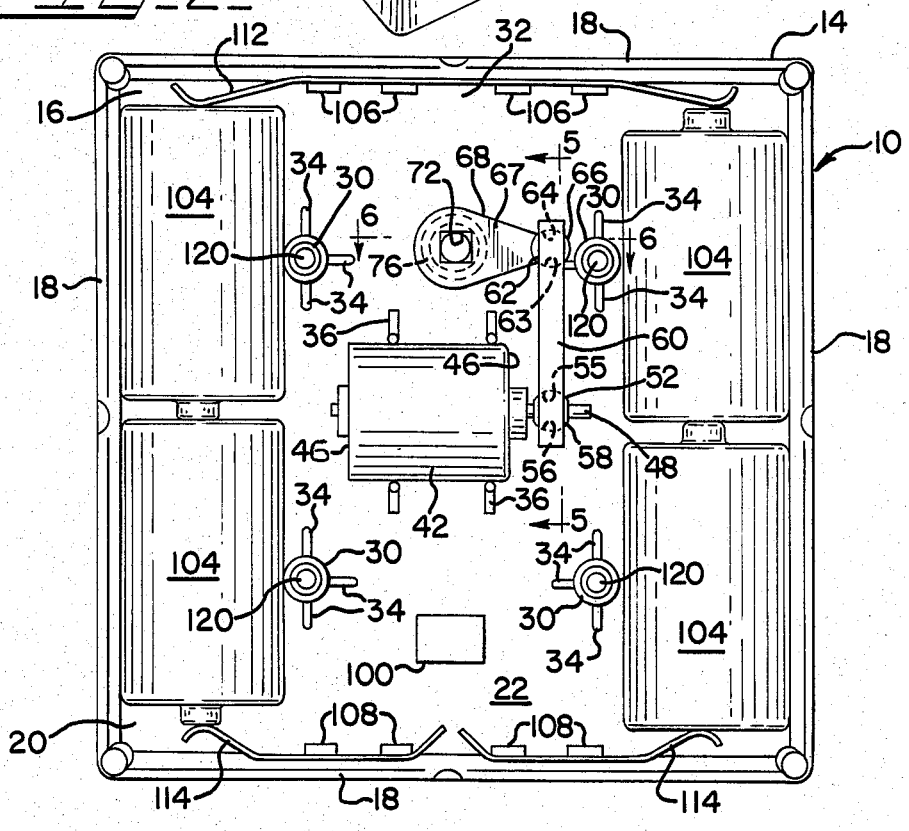

SHAKER

BACKGROUND OF THE INVENTION

1. Field of the Invention

This invention relates to devices for mixing materials in a closed container and more particularly to a shaker for mixing components of liquid base materials in miniature size containers, for example finishing materials used by a hobbyist to paint a model.

2. Prior Art

Liquid base materials such as paints and mastic may include ground solids suspended in a liquid medium. Because the components of such materials have different specific gravities, settling over time occurs. The lighter components separate upward and the heavier components downward. If settling occurs, the components are preferably remixed to return the material to a uniform consistency before use.

Mechanical devices for such mixing have been used for some time. One such small quantity mixture, perhaps directed more to amusement than to utility, is disclosed in U.S. Pat. No. 3,710,507. A drink mixing mannequin has a double crank mechanism which gyrates a torso portion of the mannequin. This motion is transferred to a small drinking glass carried by the mannequin. A further device useful for mixing small quantities of material is set forth in U.S. Pat. No. 4,061,315. This mixing device includes a holding tray connected to a cabinet through a set of bearings. The bearings are disposed at a joinder of pairs of spaced channels attached to the tray and cabinet respectively. The bearings allow a motor driven cam to rotate the tray in an orbitial path.

A still further mixer is disclosed in U.S. Pat. No. 3,735,962. This device is particularly useful for shaking the contents of jars during food preparation. This mixer has a motor driven offset crank which produces vertical reciprocation. During such reciprocation, the jar is also oscillated about its horizontal axis in that the jar holding structure connects with two sets of pivot linkages. Another mixer is shown in U.S. Pat. No. 4,235,553. Contents of a container are mixed while the container is first rotated about a vertical axis of the mixer and concurrently the container is rotated about its longitudinal axis which has been set in a vertically offset position.

SUMMARY OF THE INVENTION

A shaker of this invention is particularly adapted for mixing the components of liquid base materials held in miniature size containers. The shaker includes an inverted shell-like housing which holds a low voltage, high RPM output electric motor. The motor may be battery driven or connected to a conventional power source through an adapter. A drive shaft of the motor fits into an eccentrically offset aperture in a bearing member which in turn fits into an opening in an end of a connecting rod. In a like opening in an opposite end of the connecting rod is a ball shaped end of arm of an operating member. An upright shaft of the operating member extends through the housing with a cradle attached to an upper end of the shaft.

To mix the components of a material in a miniature size container, the container is set in the cradle such that a longitudinal axis of the container is horizontally oriented. A strap is then placed over the container with end of the strap fastened to the cradle. A pushbutton carried by the housing then may be depressed to operate a switch wherein the motor is energized. Rotation of the motor drive shaft causes the operating member, cradle and attached container to oscillate at 5000 cycles per minute about a vertical axis of the cradle.

The shaker of this invention offers several advantages.

First, the shaker provides hobbyists with a low cost, mechanized device to blend components of liquid base materials for example, a paint in a one ounce capped bottle. The material may be returned quickly to a homogeneous state, i.e., to have a uniform viscosity and color. Heretofore, such mixing was typically done manually wherein a hobbiest's arm could become tired before the pigments of the paint were uniformly dispersed throughout. Incomplete mixing may result in the paint being a different color at a top and bottom of the bottle.

Being able to quickly mix the contents of a container is particularly important to a hobbyist. In model finishing small quantities of a number of different materials are often required. This shaker allows mixing to be completed quickly, for example within a minute. Mixing of the material components is advanced first by reorienting the components to a gravitationally unstable position by placing the container on its side in the shaker cradle. Next, the container is oscillated at a high frequency subjecting the contents to pulsating centrifugal mixing forces and pulsating horizontal accelerating and deaccelerating mixing forces. The pulsating forces combine to quickly blend the contents of the containers.

A still further advantage of this shaker is its low cost. This cost advantage is achieved in part by being able to snap various components together and thus reduce the number of required fasteners. Additionally, the number of components required to complete an assembly is quite limited.

DESCRIPTION OF THE DRAWINGS

FIG. 1 is a perspective view of a shaker of this invention.

FIG. 2 is a bottom view of an interior of the shaker of FIG. 1.

DESCRIPTION OF THE PREFERRED EMBODIMENT

Figure 3:
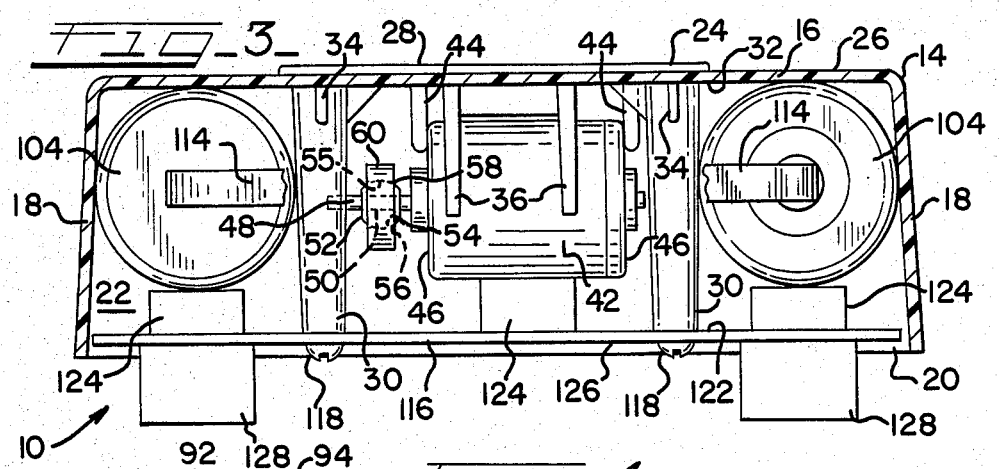
FIG. 3 is an end elevation view in section of the shaker of FIG. 1.

A shaker 10 which is particularly adapted for mixing the contents of a small volume container 12 is shown generally in FIG. 1. The shaker 10 includes a housing 14 having a top member 16 joined by four downward depending sidewalls 18. The sidewalls 18 slope slightly outward to define a bottom opening 20 to an interior space 22 of the housing 14. The housing 14 may be made of a tough, moulded, thermosetting plastic to include an integrally formed raised rib 24. The rib 24 forms part of an upper surface 26 of the housing top member 16 and defines a rectangular shaped area 28 for placement of decal (not shown). The decal may display trade indicia, for example.

Figure 4:
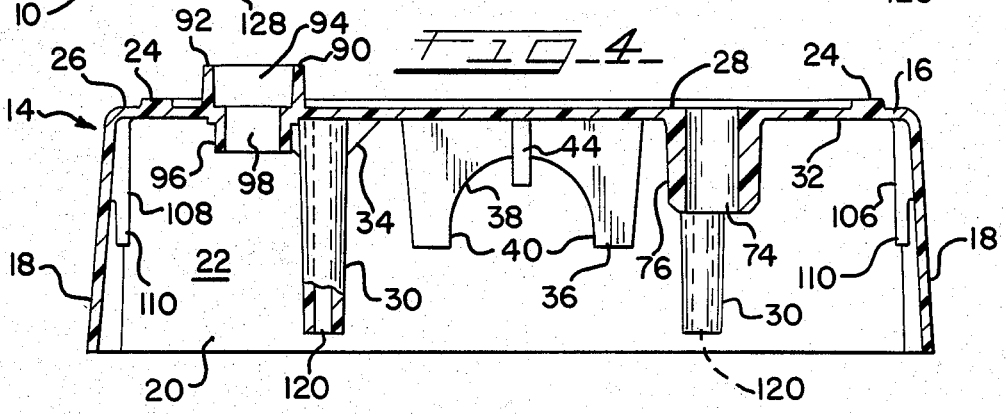
FIG. 4 is an elevation view in section of a housing of the shaker of FIG. 1.

As best seen in FIGS. 2, 3 and 4, a set of four mounting posts 30 are attached to a lower surface 32 of the housing top member 16. The posts 30 project downward into the housing interior space 22. Three gussets 34 stiffen the connection between each post 30 and the housing top member 16. Centered within the four mounting posts 30 is a pair of spaced brackets 36. Each bracket 36 is formed with a downward facing semi-circular cutout 38, best seen in FIG. 4. Each cutout 38 includes end surfaces 40 which reduce the size of the opening to each cutout 38.

This reduced size cutout opening allows a 6 volt direct current electric motor 42 to be pressed in the cutouts 38 and compressively held by the end surfaces 40. A suitable mastic may be used to help secure the motor 42. To inhibit longitudinal movement of the motor 42 within the bracket cutouts 38, a pair of spaced pins 44 extend downward from the housing top member 16 adjacent to an outer side of each bracket 36. The pins 44 are centered with respect to the bracket cutouts 38 and are selectively positioned apart to engage end walls 46 of the motor 42.

The motor 42 has a drive shaft 48 which fits into an eccentrically offset aperture 50 in a bearing member 52. The bearing member 52 has a convex shaped outer surface 54. The bearing member outer surface 54 operatively engages with a complementarily formed concave shaped groove 55 in an inner surface 56 of an opening 58 formed in one end of an connecting rod 60. In an opposite end of the connecting rod 60 is a further opening 62 having a like concave shaped groove 63 in an inner surface 64 of such. Within the connecting rod second opening 62 is a ball shaped end 66 of an arm 67 of an operating member 68. To facilitate snap-on assembly of the bearing member 52 and operating member arm ball shaped end 66 into the openings 58, 62 of the connecting rod 60, the rod 60 included a pair of elongated slots 70 which connect respectively with the openings 58, 62.

Figure 5:
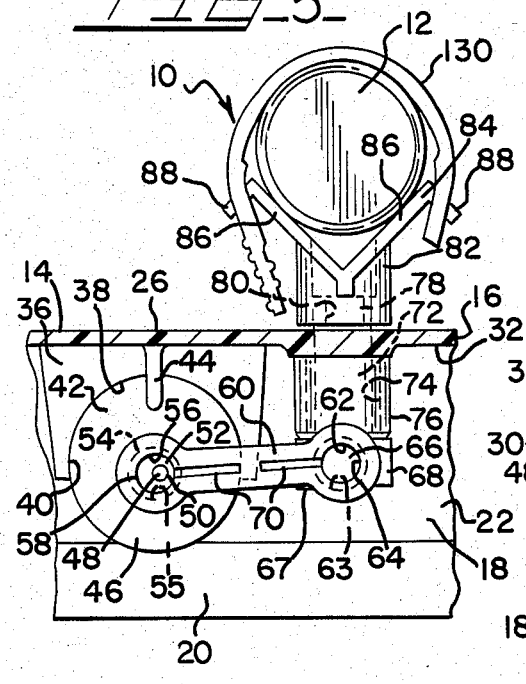
FIG. 5 is a cross section elevation view as seen generally along the line 5—5 of FIG. 2. This view has been inverted to show this shaker portion in its normal upright position.
Figure 6:
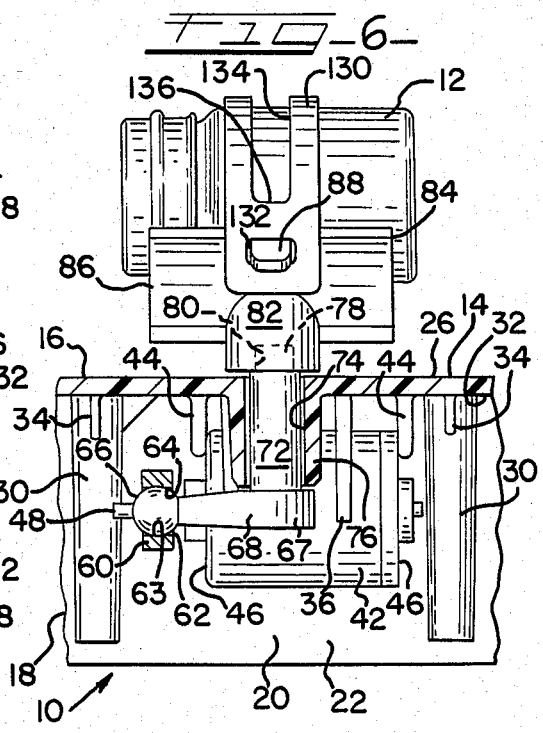
FIG. 6 is a further cross section elevation view as seen generally along the line 6—6 of FIG. 2 and also has been inverted to show the shaker in its normal position.

The operating member 68 further includes a hollow upright shaft portion 72. The shaft portion 72 fits into a vertical passageway 74 in a downward depending sleeve 76 integrally formed as part of the housing top member 16. An upper end 78 of the operating member upright shaft portion 72 is squared to fit in a like shaped opening 80 in a lower post portion 82 of a cradle 84. The cradle 84 further includes a pair of frame members 86 forming a V-shaped holding frame, best seen in FIG. 5. Each frame member 86 has a outward extending tab 88.

The housing 14 further comprises a switch fitting 90 formed as an integral part of the top member 16 and is best seen in FIGS. 1 and 4. The switch fitting 90 including an upper rim portion 92 defining a rectangular shaped receiving area 94. A lower circular portion 96 of the switch fitting 90 defines a circular passageway 98 which connects the receiving area 94 to the housing interior space 22. The passageway 98 may be threaded for securing a screw formed end of an electrical switch 100. The switch end extends into the switch fitting upper rim portion receiving area 94 where an ON/OFF pushbutton 102 may be pressed on to an operating rod member of the switch 100.

As was noted earlier, the shaker 10 can be energized by a source of 110 volt electric current through an adaptor (not shown) or battery operated. This latter configuration is seen in FIG. 2 where two pairs of 1.5 volt batteries 104 are disposed within the interior space 22 of the housing 14. Opposite sidewalls 18 of the housing 14 are each formed with two pairs of spaced apart clips 106, 108. These pairs of clips 106, 108 are best seen in FIGS. 2 and 4, and each has a bracket end portion 110. The bracket end portions 110 of the clips 106 of one sidewall 18 secure an elongated conductive strip 112 while the bracket end portions 110 of the other pairs of clips 108 each hold two shortened conductive strips 114. In a known manner ends of the shortened conductive strips 114 are connected in series with the switch 100 and motor 42 to form an electrical circuit which may be closed by operation of the switch 100.

To prepare the shaker 10 for operation, a bottom plate 116 is placed over the housing bottom opening 20. The plate 116 is attached by screws 118 threaded into an opening 120 in each mounting post 30 respectively. On a top surface 122 of the bottom plate 116 are three sponge rubber pads 124 which fit under the motor 42 and pairs of batteries 104 to help support such respectively. On a bottom surface 126 of the bottom plate 116 are four rubber mounts 128 located respectively in the corners of the plate 116. The mounts 128 hold the shaker housing 14 above a supportive surface for the shaker 10 as well as prevent the shaker 10 from moving during operation.

To operate the shaker 10, the container 12 is placed between the frame members 86 of the cradle 84. Note that the longitudinal axis of the container 12 as so positioned has been rotated typically from a vertical orientation to a horizontal orientation. This new orientation places the contents of the container 12 in a gravitationally unstable condition where the heavier components are no longer on the bottom and the lighter components are no longer on the top. Under the influence of gravity settling begins again. The container 12 next is secured in the cradle 84 by an elastic strap 130. Ends of the strap 130 each include an opening 132 for placement of the cradle frame member tabs 88. Additionally, the strap 130 has a center cutout 134. Ends 136 of the strap cutout 134 also may be fastened over the cradle tabs 88 to shorten the effective length of the strap 130 and thus accommodate different size containers 12.

With the container 12 secured in the cradle 84, the switch pushbutton 102 is depressed energizing the motor 42 to rotate the drive shaft 48 at approximately 5000 rpm. Rotation of the eccentric bearing member, in turn reciprocates the connecting rod 60 which in turn oscillates the operating member 68, attached cradle 84 and container 12 in an arc of approximately 10 degrees, 5000 times per minute.

Oscillation of the container 12 produces cyclic centrifugal and horizontal accelerating and deaccelerating forces which effect rapid mixing of the components of the material in the container 12. The centrifugal forces cause material to flow from a middle of the container 12 toward outer ends of the container 12. The horizontal accelerating and deaccelerating forces cause material to flow between sides of the containers 12. Typically, the pushbutton 102 can be depressed again within a minute in that the material components are mixed to a homogeneous consistency.

While an embodiment of this invention has been shown and described, it should be understood that the invention is not limited hereto except by the scope of the claims. Various modifications and changes can be made without departing from the scope and spirit of the invention as the same will be understood by those skilled in the art.

What I claim is:

1. A shaking device for mixing materials in miniature size container, said device comprising:

a housing having a shell-like shape defining an interior space, motor means to produce a high-speed rotary output supported in brackets carried by said housing and extending into said interior space, a circular bearing member having an eccentrically offset aperture for a drive shaft of said motor means disposed therein and a laterally radiused outer surface, a connecting rod having an expandable opening formed in ends thereof respectively, said eccentric bearing member readily disposed in one said opening with said opening formed with a surface complementary to said member radiused surface to secure said member in said opening and allow operative interaction between said member and said connecting rod, an operating member having an arm with a radiused end disposed in said opening in an opposite end of said connecting rod with said opposite end opening formed with a surface complementary to said arm radiused end to secure said arm end in said opening and allow operative interaction between said arm end and said connecting rod and an upright shaft disposed in a vertical passageway in said housing and extending outwardly therefrom, and a cradle attached to said operating member upright shaft with said cradle having spaced frame members to receive said miniature size container oriented horizontally with said container held therebetween by strap means attachable to said cradle, wherein energizing said motor means rotates said eccentric bearing member to reciprocate said connecting rod and in turn oscillate said operating member and attached cradle, said oscillation mixing said materials in said container carried by said cradle to homogenize said materials.

2. A shaker for mixing liquid base materials in miniature size containers, said shaker comprising:

a housing having an interior space defined by a top member joined by sidewalls with said interior space connecting with a bottom opening, an electric energizable motor carried in bracket means attached to a lower surface of said housing top wall, said brackets means having a cutout with sides to hold said motor with a position of said motor in said bracket means being maintained in part by pins attached to said housing top member and located at ends of said motor, a circular bearing member having an eccentrically located aperture to receive a drive shaft of said motor with said bearing member having a convex shaped outer surface, a connecting rod having an opening formed in each end of such, one said opening having an inner surface fitting complementarily about said convex outer surface of said bearing member, an operating member having an arm with a ball shaped end fitting with a complementary formed inner surface of said connecting rod other opening and an upright shaft journaled in a passageway formed in said housing top member, a cradle having a lower post portion connected with an end of said operating member upright shaft extending above said housing passageway and a pair of angularly positioned frame members connecting with said lower post portion, and strap means to hold said container between said cradle frame members with said strap means having ends prepared for ready engagement with holding tabs on said cradle frame members, wherein energizing said motor results in rapid oscillation of said cradle to mix materials in said container.

3. A shaker as defined by claim 2 and further characterized by including, a switch mount formed as an integral part of said housing top member with said mount having a receiving area for a pushbutton and a lower post portion for a switch operatively connecting with said pushbutton.

4. A shaker as defined by claim 2 and further characterized by including, clips carried by said housing with said clips formed with bracket ends to hold conductive strips to selectively engage terminal ends of batteries in said housing, and a bottom plate secured to mounting posts carried by said housing and extending into said interior space with said plate having pads positioned to secure said batteries in a fixed location within said housing.

5. A shaker as defined by claim 4 and further characterized by, pairs of said clips attached to opposing sidewalls of said housing respectively with said clips on one said sidewall carrying an elongated conductive strip to join in series a positive terminal of one battery and a negative terminal of another battery, and said clips on said other sidewall carrying a first shortened conductive strip to join a positive terminal of a further battery and a second shortened conductive strip to join a negative terminal of a still further battery.

6. A shaker as defined by claim 2 and further characterized by, said connecting rod having a pair of slots connecting one each with said end openings with an inner surface of each said opening formed with a concave shaped groove, wherein said bearing member and said operating member ball shaped end may be snapped into said connecting rod openings respectively to facilitate assembly thereof.

* * * * *